US008731449B2

(12) United States Patent
Yagi et al.

(10) Patent No.: US 8,731,449 B2
(45) Date of Patent: May 20, 2014

(54) IMAGE FORMING APPARATUS WITH URGING MEMBER WITH PROJECTED PORTION TO URGE SHEET AGAINST TRANSFER BELT

(75) Inventors: Yasutaka Yagi, Mishima (JP); Yoshiro Saito, Boise, ID (US); Tomonori Shida, Mishima (JP); Hiroyuki Seki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/556,485

(22) Filed: Jul. 24, 2012

(65) Prior Publication Data

US 2013/0028642 A1 Jan. 31, 2013

(30) Foreign Application Priority Data

Jul. 29, 2011 (JP) ..... 2011-167331

(51) Int. Cl.
*G03G 15/16* (2006.01)

(52) U.S. Cl.
USPC ..... 399/313; 399/121; 399/297; 399/299; 399/308

(58) Field of Classification Search
USPC ..... 399/66, 121, 297, 308, 313, 299, 302
See application file for complete search history.

(56) References Cited

U.S. PATENT DOCUMENTS

| | | | | |
|---|---|---|---|---|
| 5,176,376 | A | 1/1993 | Igaki et al. | |
| 5,508,796 | A | 4/1996 | Sasame et al. | |
| 5,523,829 | A | 6/1996 | Miyashiro et al. | |
| 5,666,597 | A | 9/1997 | Sasame et al. | |
| 5,893,665 | A * | 4/1999 | Ichikawa et al. | 399/314 |
| 6,836,641 | B2 | 12/2004 | Uchida et al. | |
| 6,947,701 | B2 | 9/2005 | Uchida et al. | |
| 7,835,678 | B2 * | 11/2010 | Yasumaru et al. | 399/308 |
| 8,005,411 | B2 * | 8/2011 | Nakagawa et al. | 399/303 |
| 8,199,375 | B2 | 6/2012 | Saito et al. | |
| 2009/0196663 | A1 * | 8/2009 | Yasumaru et al. | 399/308 |
| 2010/0158586 | A1 * | 6/2010 | Yasumaru et al. | 399/313 |
| 2010/0278567 | A1 * | 11/2010 | Nakagawa et al. | 399/310 |
| 2011/0188902 | A1 * | 8/2011 | Katagiri et al. | 399/308 |
| 2011/0318069 | A1 * | 12/2011 | Nishizawa | 399/308 |
| 2012/0003018 | A1 * | 1/2012 | Kudo | 399/313 |

FOREIGN PATENT DOCUMENTS

| | | | |
|---|---|---|---|
| JP | 2007-156455 | A | 6/2007 |
| JP | 2008-310060 | A | 12/2008 |
| JP | 2009204809 | A * | 9/2009 |
| JP | 2010-262088 | A | 11/2010 |
| JP | 2012-13883 | A | 1/2012 |

* cited by examiner

*Primary Examiner* — David Gray
*Assistant Examiner* — Francis Gray
(74) *Attorney, Agent, or Firm* — Fitzpatrick, Cella, Harper & Scinto

(57) ABSTRACT

An image forming apparatus includes an image bearing member on which a toner image is to be formed; a transfer device for transferring the toner image carried on the image bearing member; and a rotationally movable endless transfer belt onto which the toner image is to be transferred or on which a transfer material onto which the toner image is to be transferred is to be conveyed. The transfer device includes a sheet member contacted to an inner peripheral surface of the transfer belt while being supported by a supporting member at an end thereof and includes an urging member for urging the sheet member against the transfer belt in contact to the sheet member. The urging member includes a projected portion projected toward the transfer belt at its downstream end portion more than at its upstream end portion with respect to a movement direction of the transfer belt.

14 Claims, 7 Drawing Sheets

IMAGE FORMING APPARATUS WITH URGING MEMBER WITH PROJECTED PORTION TO URGE SHEET AGAINST TRANSFER BELT

FIELD OF THE INVENTION AND RELATED ART

The present invention relates to an image forming apparatus, such as a printer or a copying machine, in which a toner image carried on an image bearing member is transferred onto an intermediary transfer member or a transfer material carried on a transfer material conveying member.

In a conventional electrophotography, there is an image forming apparatus in which the toner image is transferred from the image bearing member into a belt-like intermediary transfer member, i.e., an intermediary transfer belt, nipped between the image bearing member for carrying the toner image and a transfer roller. Further, there is an image forming apparatus in which a belt-like transfer material conveying member for conveying the transfer material, i.e., a transfer material conveying belt is nipped between the image bearing member and the transfer roller, and the toner image is transferred from the image bearing member onto the transfer material on the belt.

Here, a region where the transfer roller and the belt contact, i.e., a so-called transfer nip is important for ensuring a good transfer property and is required to be enlarged in order to suppress abnormal electric discharge. Here, the abnormal electric discharge refers to electric discharge which locally occurs in the case where a predetermined potential difference is generated in a space formed by the belt and the image bearing member. By this electric discharge, in some cases, the toner image on the intermediary transfer belt or the transfer material conveying belt is scattered.

However, in the case where the transfer roller is used, in order to increase the transfer nip region, there is only a method of increasing a roller diameter or decreasing a hardness of the transfer roller and therefore there is a limit when downsizing of the apparatus and manufacturing stability are taken into consideration. Based on these circumstances, in Japanese Laid-Open Patent Application (JP-A) 2007-156455 and JP-A 2008-310060, a method in which an electroconductive sheet member is provided as a transfer member in place of the transfer roller and is urged by an elastic urging member to cause the belt and the sheet member to hermetically contact to each other and thus a broad nip region is formed has been proposed.

However, in the case where a hermetic contact property of the sheet member to the belt is insufficient, an end portion of the sheet member is separated from the belt to narrow the transfer nip region. As a result, a sufficient transfer nip region cannot be ensured and thus there is a possibility that an image defect due to the abnormal electric discharge occurs.

SUMMARY OF THE INVENTION

A principal object of the present invention is to provide an image forming apparatus capable of suppressing an image defect due to abnormal electric discharge by ensuring a hermetic contact property between an electroconductive sheet member as a transfer member and an intermediary transfer member or a transfer material conveying member.

According to an aspect of the present invention, there is provided an image forming apparatus comprising: an image bearing member on which a toner image is to be formed; a transfer device for transferring the toner image carried on the image bearing member; and a rotationally movable endless transfer belt onto which the toner image is to be transferred or on which a transfer material onto which the toner image is to be transferred is to be conveyed, wherein the transfer device includes a sheet member contacted to an inner peripheral surface of the transfer belt while being supported by a supporting member at an end thereof and includes an urging member for urging the sheet member against the transfer belt in contact to the sheet member, and wherein the urging member includes a projected portion projected toward the transfer belt at its downstream end portion more than at its upstream end portion with respect to a movement direction of the transfer belt.

These and other objects, features and advantages of the present invention will become more apparent upon a consideration of the following description of the preferred embodiments of the present invention taken in conjunction with the accompanying drawings.

Figure 2:
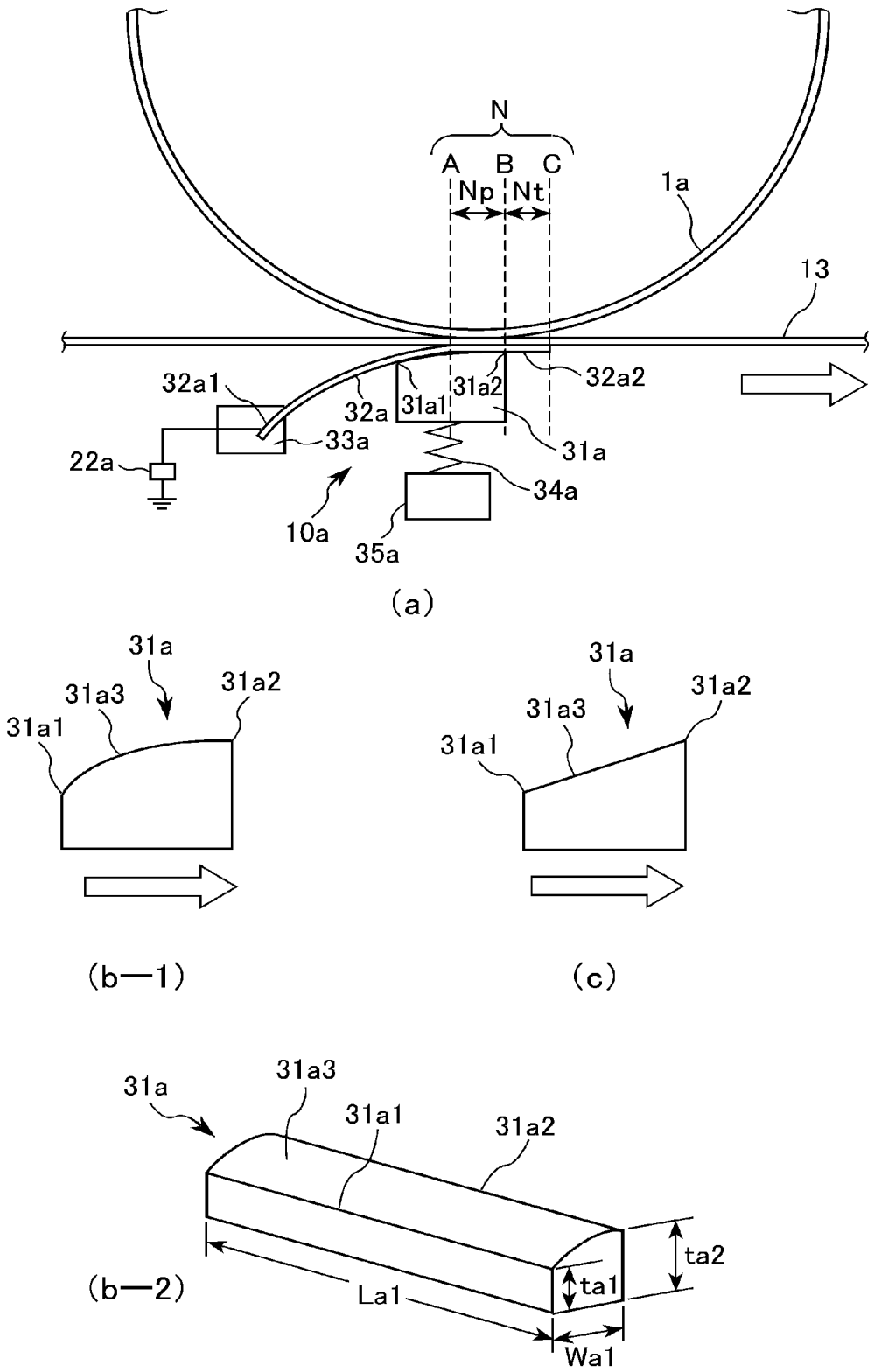

Parts (a) to (c) of FIG. 2 are schematic views for illustrating an example of a primary transfer member, wherein (a) is a schematic view for illustrating a relation among the primary transfer member, a photosensitive drum and an intermediary transfer belt, (b-1) is a side view of an example of an urging member constituting the primary transfer member, (b-2) is a perspective view of the urging member of (b-1), and (c) is a side view of another example of the urging member.

Figure 3:
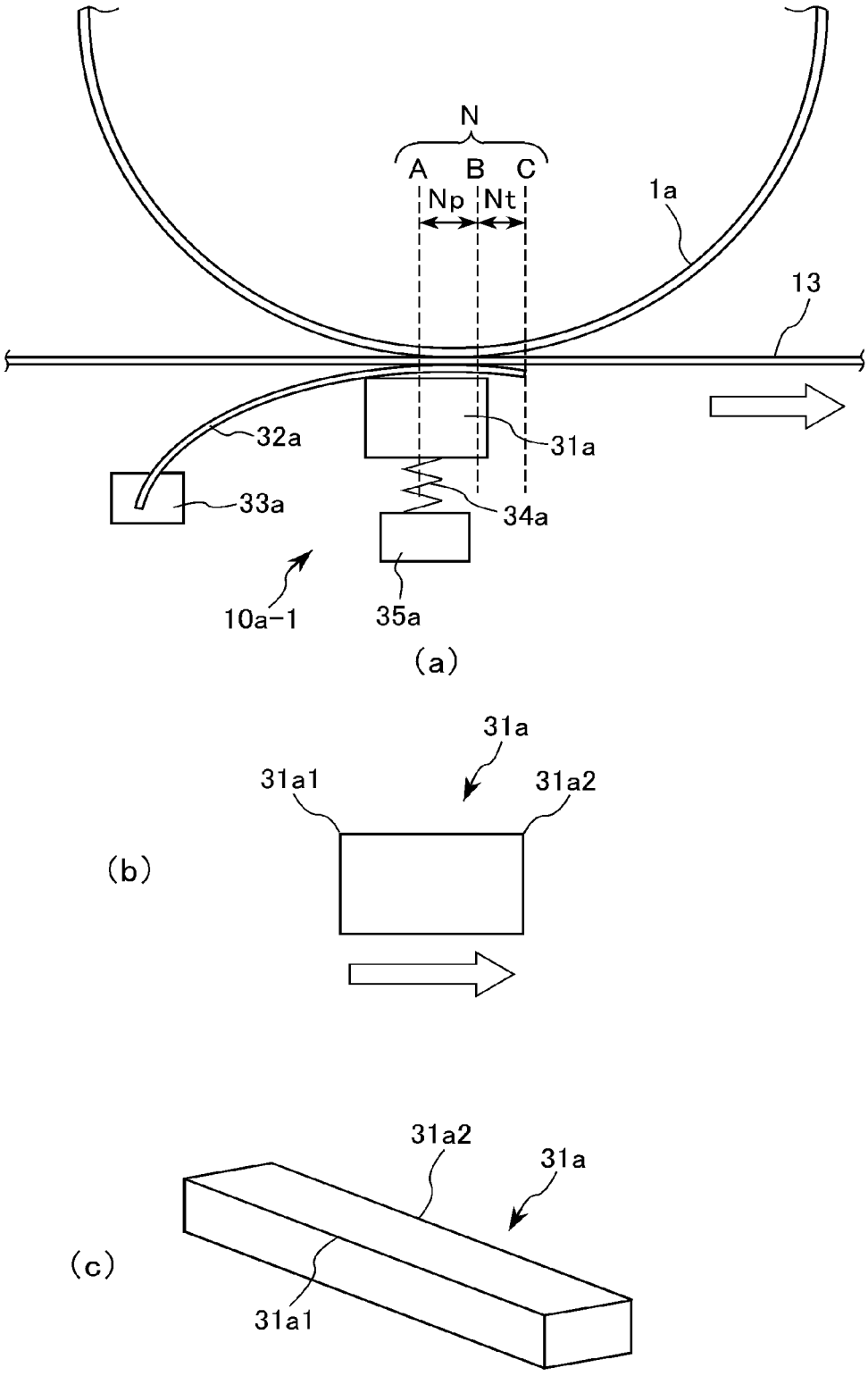

Parts (a) to (c) of FIG. 3 are schematic views for illustrating an example of a primary transfer member of Comparative Embodiment, wherein (a) is a schematic view for illustrating a relation among the primary transfer member, a photosensitive drum and an intermediary transfer belt, (b) is a side view of an urging member constituting the primary transfer member, and (c) is a perspective view of the urging member of (b).

Figure 4:
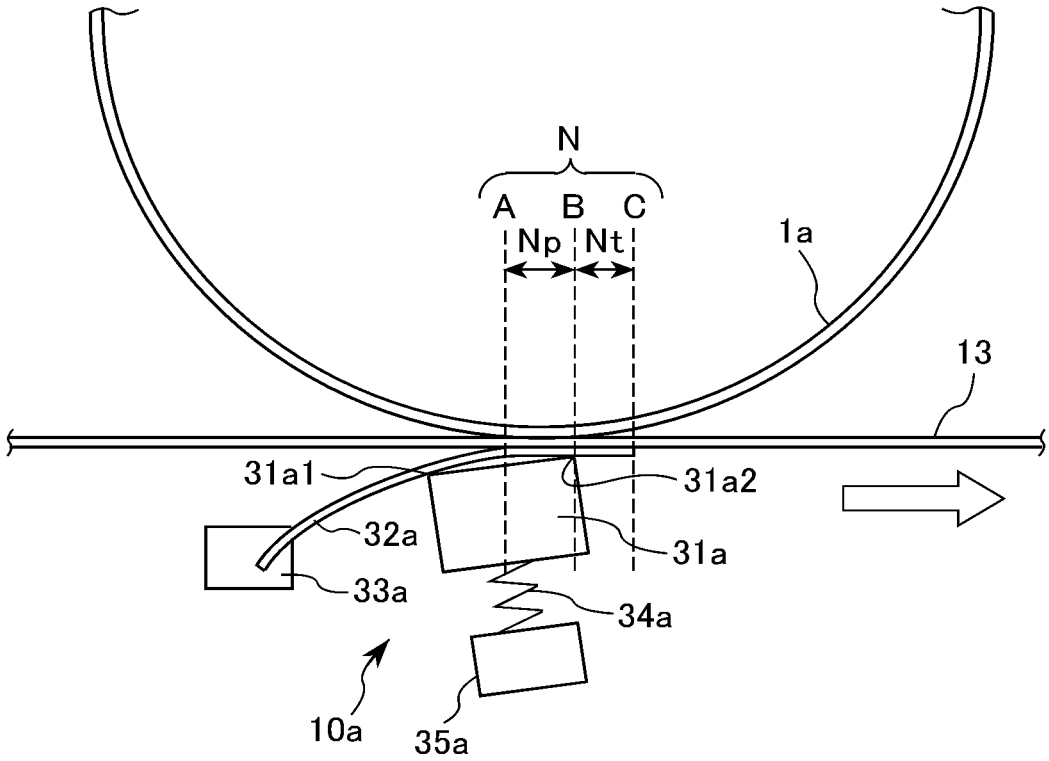

FIG. 4 is a schematic view for illustrating another example of the primary transfer member.

Figure 5:
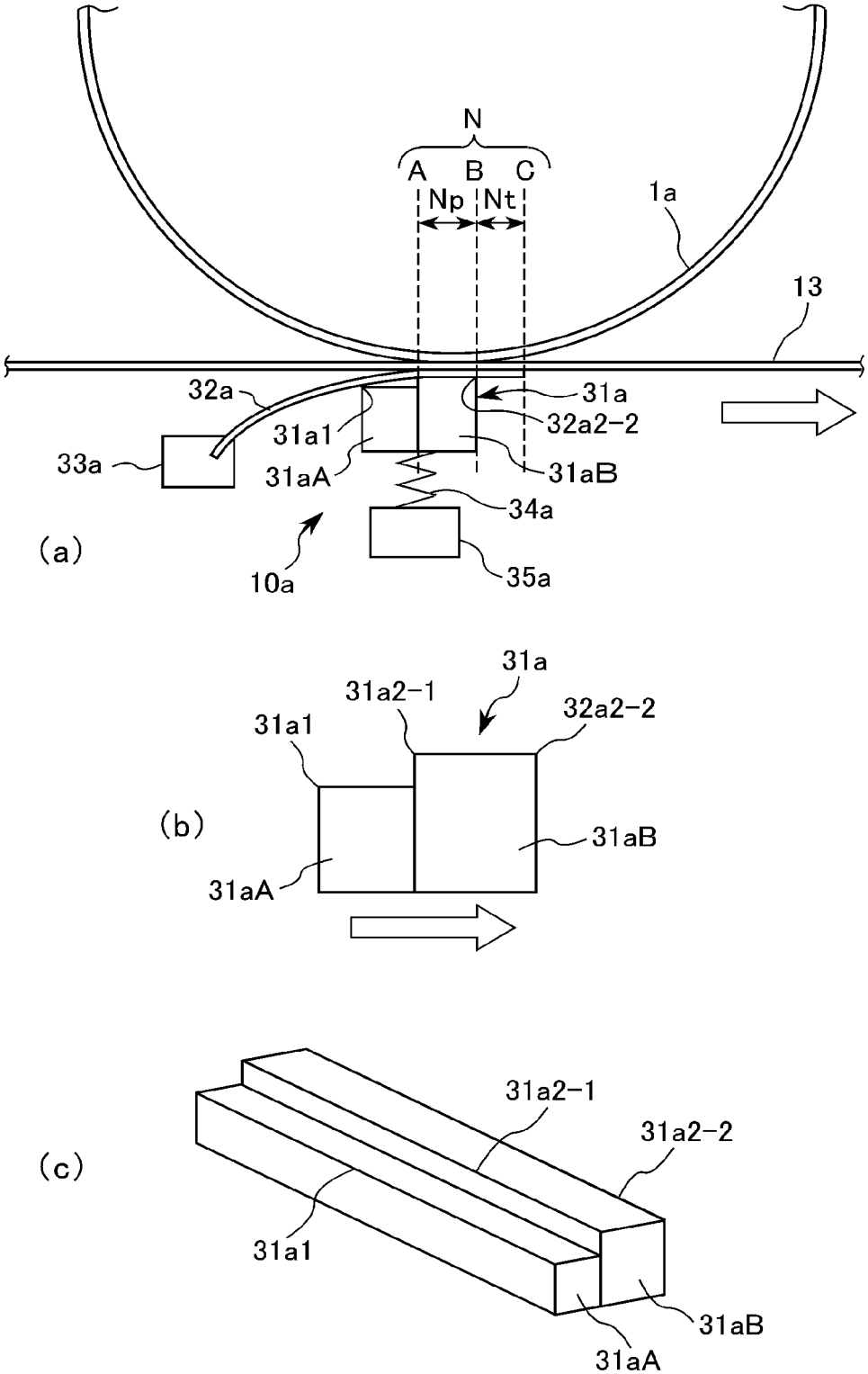

Parts (a) to (c) of FIG. 5 are schematic views for illustrating another example of the primary transfer member, wherein (a) is a schematic view for illustrating a relation among the primary transfer member, a photosensitive drum and an intermediary transfer belt, (b) is a side view of another example of an urging member constituting the primary transfer member, and (c) is a perspective view of the urging member of (b).

Figure 6:
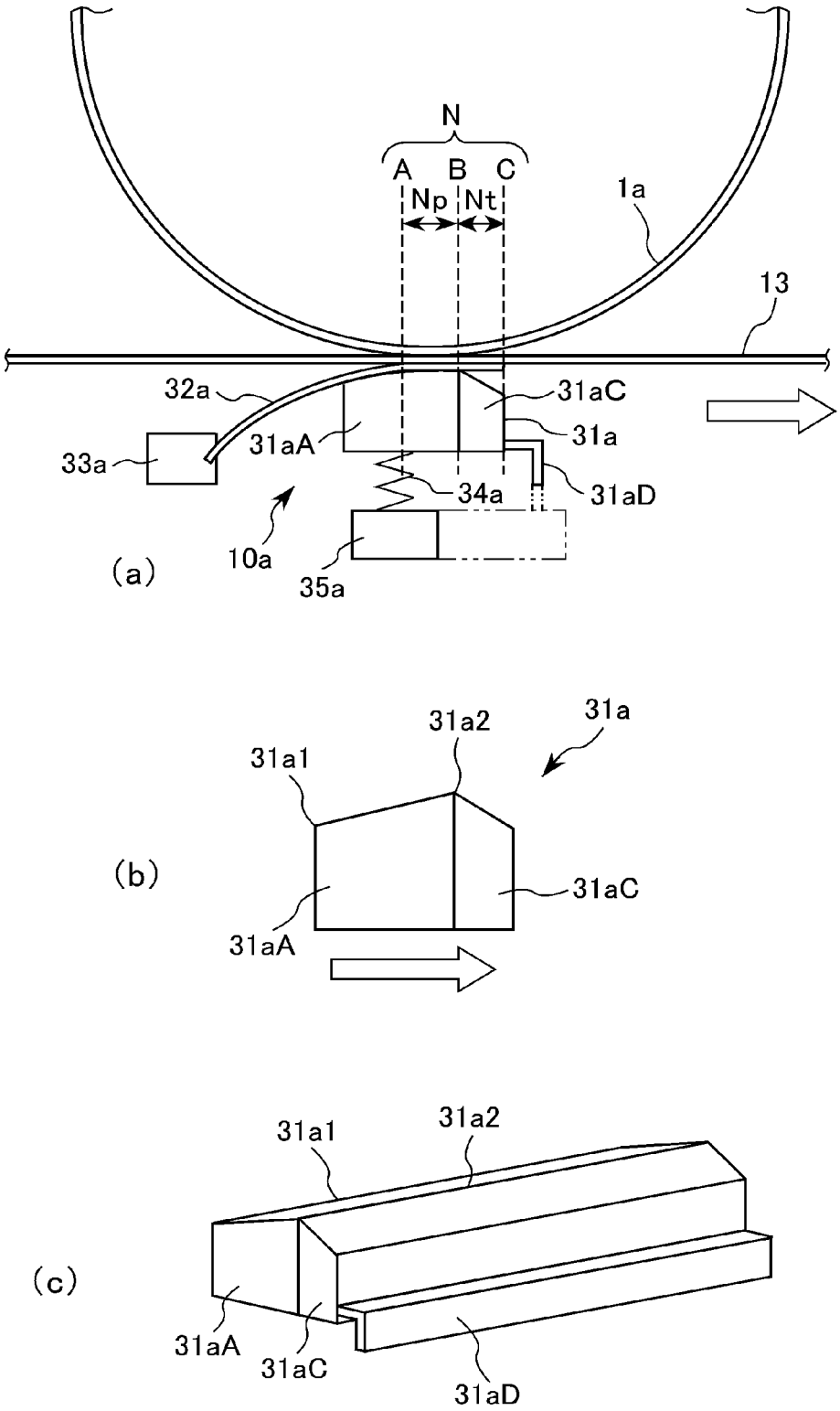

Parts (a) to (c) of FIG. 6 are schematic views for illustrating another example of the primary transfer member, wherein (a) is a schematic view for illustrating a relation among the primary transfer member, a photosensitive drum and an intermediary transfer belt, (b) is a side view of another example of an urging member constituting the primary transfer member, and (c) is a perspective view of the urging member of (b).

Figure 7:
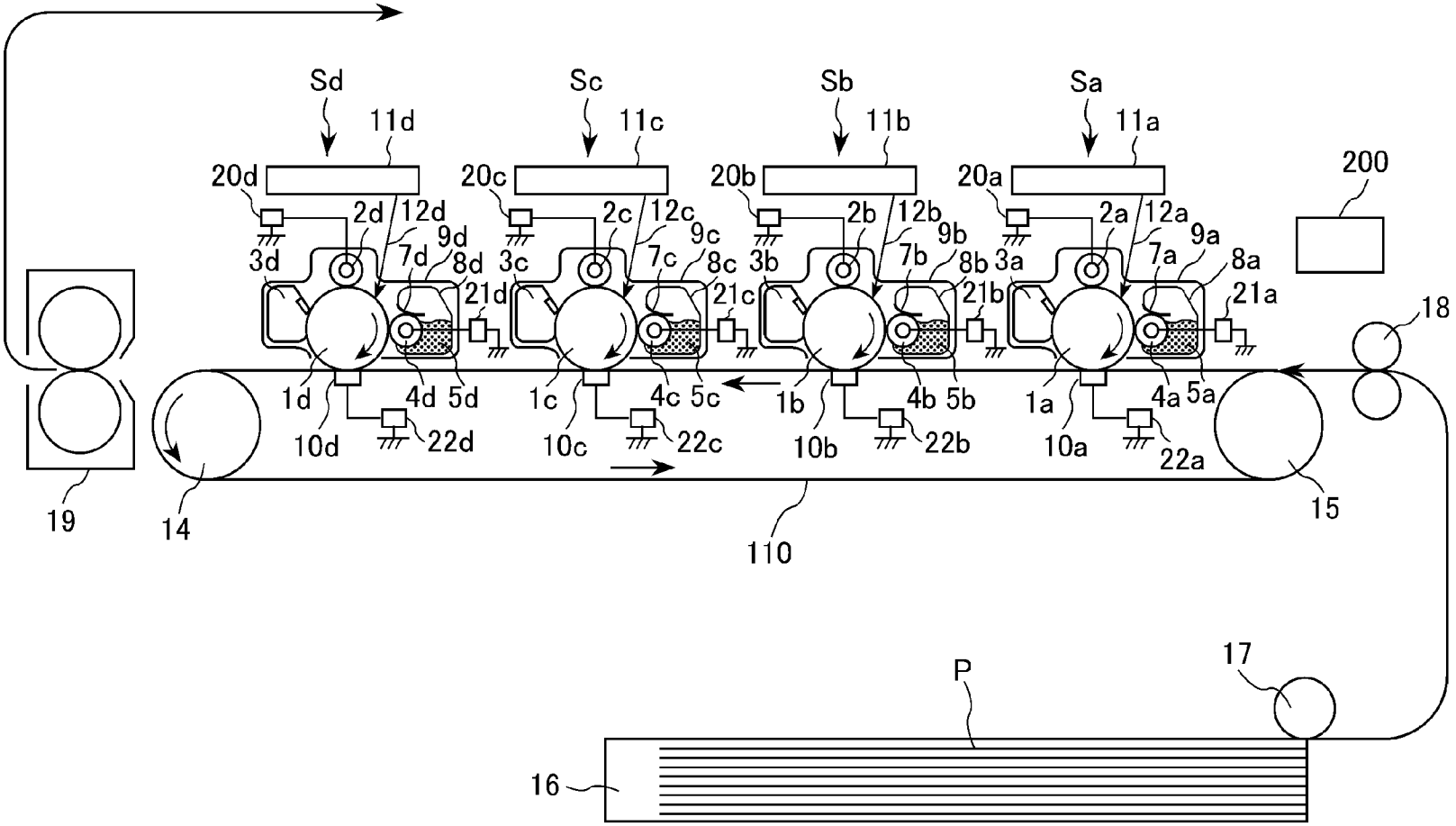

FIG. 7 is a schematic view for illustrating another embodiment of the image forming apparatus according to the present invention.

DESCRIPTION OF THE PREFERRED EMBODIMENTS

Hereinbelow, embodiments for carrying out the present invention will be specifically described with reference to the drawings. However, dimensions, materials, shapes, relative arrangements and the like of constituent elements described in the following embodiments should be appropriately modified depending on constitutions and various conditions of image forming apparatuses to which the present invention is applied. Therefore, the scope of the present invention is not limited thereto unless otherwise specified.

The image forming apparatus according to the present invention will be described below with reference to the drawings.

First Embodiment

Figure 1:
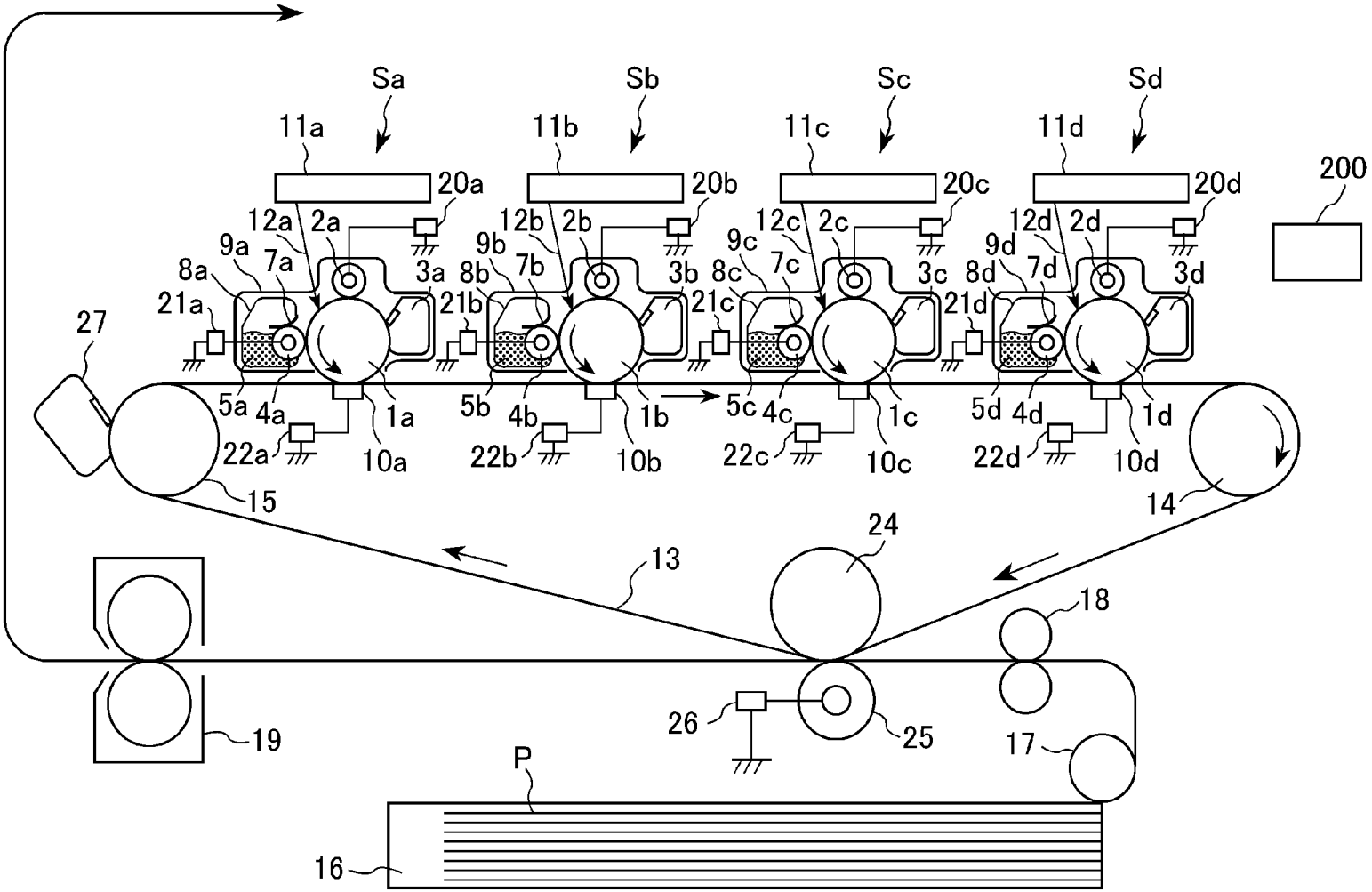
FIG. 1 is a schematic illustration of an image forming apparatus according to an embodiment of the present invention.

FIG. 1 shows a schematic illustration of a multi-color image forming apparatus, as an example of the image forming apparatus according to the present invention, including a plurality of image forming portions (stations).

The image forming apparatus in this embodiment includes four stations (Sa, Sb, Sc, Sd), in which a first station Sa is for yellow (Y), a second station Sb is for magenta (M), a third station Sc is for cyan (C), and a fourth station Sd is for black (K). The first station Sa includes an OPC photosensitive drum 1*a* as an image bearing member which is rotatably carried. At a periphery of the photosensitive drum 1*a*, a charging roller 2*a* as a charging device, a cleaning unit 3*a* as a cleaning device for removing a transfer residual toner on the photosensitive drum 1*a*, and a developing unit 8*a* as a developing device. The developing unit 8*a* includes a developing sleeve 4*a*, a non-magnetic one-component toner 5*a*, and a developer applying blade 7*a*. The above-described members of the photosensitive drum 1*a*, the charging roller 2*a*, the cleaning unit 3*a*, and the developing unit 8*a* constitute a process cartridge 9*a* of an integral type.

An exposure device 11 is constituted by a scanner unit for scanning the photosensitive drum 1*a* with laser light through a polygonal mirror and irradiates the surface of the photosensitive drum 1*a* with scanning beam 12*a* modulated on the basis of an image signal. Further, the charging roller 2*a* is connected to a developing power source 21*a* as a voltage supplying device 20*a* which is a voltage supplying device to the charging roller 2*a*. Further, a primary transfer member 10*a* as a primary transfer means which will be specifically described later is connected to a primary transfer power source 22*a* as a voltage supplying device to the primary transfer member 10*a*, and a secondary transfer roller 25 is connected to a secondary transfer power source 26.

Next, an image forming operation on the photosensitive drum 1*a* will be described. In this embodiment, an endless belt 13 as an intermediary transfer member (hereinafter referred to as an intermediary transfer belt) is provided under the four stations Sa to Sd. The intermediary transfer belt 13 is stretched around a driving roller 14, a tension roller 15 and a secondary transfer opposite roller 24 and is rotationally moved in an arrow direction.

When the image forming operation is started, the photosensitive drums 1*a* to 1*d*, the intermediary transfer belt 13, and the like start their rotations in directions indicated by arrows at predetermined process speeds. The photosensitive drum 1*a* is uniformly charged to a negative polarity by the charging roller 2*a* and then, on the photosensitive drum 1*a*, an electrostatic latent image in accordance with image information is formed by the scanning beam 12*a* from the exposure device 11.

A toner 5*a* in the developing unit 8*a* is charged to the negative polarity by the developer applying blade 7*a* and is applied onto the developing sleeve 4*a*. Then, to the developing sleeve 4*a*, a bias is supplied from a developing bias power source 21*a*, and when the photosensitive drum 1*a* is rotated and the electrostatic latent image formed on the photosensitive drum 1*a* reaches the developing sleeve 4*a*, the electrostatic latent image is visualized by the toner 5*a* of the negative polarity. As a result, a toner image of a first color (Y in this embodiment) is formed on the surface of the photosensitive drum 1*a*. Incidentally, also the second to fourth stations Sb and Sd have the same constitution as and perform the same operation as those of the first station Sa, so that toner images of second to fourth colors (M, C and K in this embodiment) are formed on the surfaces of the respective photosensitive drums 1*b* to 1*d*. Therefore, the image forming operations of the second to fourth stations Sb to Sd will be omitted from description.

The intermediary transfer belt 13 is, as shown in FIG. 1, disposed so as to be contacted to all the four photosensitive drums 1*a* to 1*d*.

Next, a transfer operation will be described. The intermediary transfer belt 13 is, as described above, movable supported by three rollers, as its stretching member, consisting of the secondary transfer opposite roller 24, the driving roller 14, and the tension roller 15, and is configured to be held under a proper tension. The intermediary transfer belt 13 is moved at the substantially same speed as and in the same direction as those of the photosensitive drums 1*a* to 1*d* by driving the driving roller 14. Further, the intermediary transfer belt 13 is rotationally moved in an arrow direction, and the primary transfer member 10*a* is disposed opposite to the photosensitive drum 1*a* with respect to the intermediary transfer belt 13. In the following, "upstream" and "downstream" refer to those with respect to a movement direction of the intermediary transfer belt 13.

As is understood from the above, at a periphery of the intermediary transfer belt 13 and at opposing portions of the photosensitive drums 1*a* to 1*d*, the primary transfer members 10*a* to 10*d* are disposed correspondingly to the photosensitive drums 1*a* to 1*d*, respectively. The electrostatic latent image by the exposure is formed on each of the photosensitive drums 1*a* to 1*d* while delaying a writing signal from a controller 200 with certain timing for each color depending on a distance between adjacent primary transfer positions for the respective colors. Then, to the primary transfer members 10*a* to 10*d*, voltages of an opposite polarity (positive in this embodiment) to the charge polarity of the toner images are applied by the primary transfer voltage sources 22*a* to 22*d*, respectively. By the above steps, the respective color toner images are primary-transferred successively onto the intermediary transfer belt 13, so that multiplex toner images (multiplex images) are formed on the intermediary transfer belt 13.

Thereafter, in synchronism with the formation of the electrostatic latent image by the exposure, a transfer material P as a recording material stacked in a transfer material cassette 16 is picked up by a sheet feeding roller 17 and is conveyed to registration rollers 18 by unshown conveying rollers. Then, the transfer material P is conveyed to a contact portion formed between the intermediary transfer belt 13 and the secondary transfer roller (secondary transfer means) 25 by the registration rollers 18 in synchronism with the toner images on the intermediary transfer belt 13. Thereafter, to the secondary transfer roller 25 connected, a voltage of an opposite polarity (positive in this embodiment) to the toner charge polarity of the toner is applied from the secondary transfer voltage source 26, so that the multiplex four color toner images carried on the intermediary transfer belt 13 are collectively secondary-transferred onto the transfer material P.

Incidentally, in this embodiment, as the secondary transfer roller 25, a roller of 18 mm in outer diameter prepared by coating a nickel-plated steel rod of 8 mm in outer diameter with a sponge foam member of NBR adjusted to $10^8$ Ω·cm in volume resistivity and 5 mm in thickness was used. Further, the secondary transfer roller 25 was disposed so that it was contacted to the intermediary transfer belt 13 at a linear pressure of about 5-15 g/cm and was rotated at the substantially same speed as and in the same direction as those of the intermediary transfer belt 13 with respect to the movement direction of the intermediary transfer belt 13.

On the other hand, after the secondary transfer is completed, transfer residual toner remaining on the intermediary transfer belt 13 and paper powder generated by conveying the transfer material P are removed and collected from the surface of the intermediary transfer belt 13 by a belt cleaning device 27 disposed in contact with the intermediary transfer belt 13. Incidentally, in the image forming apparatus in this embodiment, as the belt cleaning device 27, a cleaning blade formed of an urethane rubber or the like and having elasticity was used. Further, the transfer material P after the completion of the secondary transfer is conveyed into a fixing means 19 and is subjected to fixation of the toner images and then is discharged to the outside of the image forming apparatus as an image-formed product (print or copy). Incidentally, the intermediary transfer belt 13 is formed of polyimide (PI) in a thickness of 100 μm to have a volume resistivity of $10^{10}$ Ω·cm.

As the driving roller 14 as a stretching member, a roller of 25 mm in outer diameter prepared by coating a core metal of aluminum with a 1.0 mm-thick EPDM rubber in which carbon black is dispersed as an electroconductive agent to have a volume resistivity of $10^4$ Ω·cm is used. The tension roller 15 as the stretching member is formed with a metal rod of aluminum to have an outer diameter of 25 mm, and tension if 19.6 N on each side, i.e., 39.2 N as a total pressure. As the secondary transfer opposite roller 25 as a stretching member, a roller of 25 mm in outer diameter prepared by coating a core metal of aluminum with a 1.5 mm-thick EPDM rubber in which carbon black is dispersed as an electroconductive agent to have a volume resistivity of $10^4$ Ω·cm is used.

In the following, a feature of this embodiment will be described. Parts (a) to (c) of FIG. 2 are enlarged sectional views of respective portions of the primary transfer portion of the first station Sa. Other stations have the same constitution as that of the first station Sa and therefore will be omitted from description. The primary transfer member 10*a* includes, as shown in (a) of FIG. 2, an urging member 31*a* and a flexible sheet member 32*a*. One end 32*a*1 of the sheet member 32*a* is supported by a supporting member 33*a* and a free end 32*a*2 as the other end is provided with a moderate curve and is sandwiched between the intermediary transfer belt 13 and the urging member 31*a* while being contacted to an inner surface of the intermediary transfer belt 13.

Specifically, in this embodiment, as the sheet member 32*a*, a resinous sheet having a volume resistivity of $10^6$ Ω·cm under application of a voltage of 50 V is used. In this embodiment, as the sheet member 32*a*, a vinyl acetate sheet is used but it is also possible to use polycarbonate (PC), Pvdf, PET, polyimide (PI), polyethylene (PE), polyamide (PA), ultra high molecular weight polyethylene, and the like. With respect to the thickness, 30 μm to 500 μm is desirable. In this embodiment, the sheet member 32*a* of 150 μm in thickness is used. This is because in the case where the sheet member in a thickness out of the above range is used, the contact by rigidity of the sheet member 32*a* cannot be effected. In the case where the thickness is less than 30 μm, the rigidity is remarkably lowered and the sheet member is slidable to cause deformation (crease), so that an image defect is liable to occur. Further, in the case where the thickness is more than 500 μm, the rigidity is excessively high and thus the sheet member cannot form the moderate curve, so that it becomes difficult to ensure a transfer nip region.

Further, to the sheet member 32*a*, the primary transfer power source 22*a* is connected, and a voltage of 500 V is applied during an image forming operation. Further, the urging member 31*a* is held by a base 35*a* as a holding member via an urging spring 34*a* in this embodiment and is urged toward the photosensitive drum la with the total pressure of 9.8 N. The supporting member 33*a* of the sheet member 32*a* and the holding member 31*a* of the urging member 31*a* can also be constituted integrally as desired.

As the urging member 31*a*, an elastic member, of an insulating material in a foam urethane sponge shape, which is 2 mm in upstream side thickness (short side) (ta1), 3 mm in downstream side thickness (long side) (ta2), 4 mm in width (wa1) and 230 mm in length (La1) with respect to a direction perpendicular to a direction of the width (wa1). The urging member 31*a* has a hardness of 30 degrees in terms of ASKER C hardness under a load of 500 gf. In this embodiment, as a material for the urging member 31*a*, the foam urethane is used but it is also possible to use a rubber material such as epichlorohydrin rubber, NBR (nitrile rubber) or EPDM (ethylene-propylene-diene rubber).

Here, nip regions will be described. First, herein, the sum of regions of two types consisting of a physical nip region Np and a downstream tension nip region Nt which are described below is referred to as a transfer nip region N.

The physical nip region Np is a region where three members consisting of the photosensitive drum 1*a*, the intermediary transfer belt 13 and the sheet member 32*a* contact in (a) of Figure, i.e., a region between boundary positions A and B. From the sheet member 32*a* to which the voltage of 500 V is applied, positive electric charges are injected through the physical nip region Np to constitute carrying electric charges of the toner transferred from the intermediary transfer belt 13 onto the intermediary transfer belt 13, so that the primary transfer is effected.

Further, the downstream tension nip region Nt is a region, between boundary positions B and C, where the intermediary transfer belt 13 and the sheet member 32*a* contact. The downstream tension nip region Nt is a region where the photosensitive drum 1*a* does not contact the intermediary transfer belt 13. As described above, the positive electric charges injected at the physical nip region Np principally constitute the toner carrying electric charges on the intermediary transfer belt 13. On the other hand, the excessive positive electric charges which are not used as the toner carrying electric charges are returned to the sheet member 32*a* by circulation of the electric charges at the downstream tension nip region Nt. By this action, an occurrence of abnormal electric discharge between the photosensitive drum 1*a* and the intermediary transfer belt 13 at a downstream portion of the transfer nip region N can be suppressed.

Therefore, when the downstream tension nip region Nt cannot be ensured sufficiently, i.e., when close (intimate) contactness between the intermediary transfer belt 13 and the sheet member 32*a* is not sufficient, the excessive positive electric charges remain on the surface of the intermediary transfer belt 13 and thus an intermediary transfer belt surface potential at the downstream portion of the transfer nip region N is increased, so that the abnormal electric discharge occurs between the intermediary transfer belt 13 and the photosensitive drum 1*a* occurs and thus the image defect is caused.

A measuring method of the above-described boundary positions A, B and C will be described below. With respect to the boundary position B formed by the photosensitive drum

1*a* and the intermediary transfer belt 13, the belt drive is stopped and the photosensitive drum 1*a* is rotated in a state in which the toner image is present on the intermediary transfer belt 13. At this time, the toner image is removed only in the region where the photosensitive drum 1*a* and the intermediary transfer belt 13 contact and therefore the measurement of the boundary positions A and D can be performed by measuring its downstream positions.

Incidentally, when the measuring method is based on the same concept, e.g., a method in which the intermediary transfer belt 13 is marked (colored) with a vermilion ink pad, a Magic Marker or the like and its removal portion is measured may also be employed.

With respect to the boundary position A formed by the intermediary transfer belt 13 and the sheet member 32*a*, it is required to be considered that the boundary position A is a contact point between the flexible sheet member 32*a* and the intermediary transfer belt 13. In addition, influences of a frictional force by the rotational drive of the intermediary transfer belt 13 and the electrostatic attraction force by the voltage application to the sheet member 32*a* are required to be taken into consideration. Therefore, when the intermediary transfer belt 13 is rotated in a state in which the bias (voltage) is applied to the sheet member 32*a*, the boundary position A is measured on the basis of the contact region formed by the sheet member 32*a* and the intermediary transfer belt 13.

With respect to the boundary position C formed by the intermediary transfer belt 13 and the sheet member 32*a*, a contact point is measured through a cross section observation.

From the respective boundary positions (lines) obtained by the above-described measurement, the physical nip region Np (between A and B) was 2.5 mm and the downstream tension nip region Nt (between B and C) was 0.5 mm. Incidentally, with respect to the second to fourth stations Sb to Sd, the same constitution as that of the first station Sa is employed and therefore will be omitted from description.

In this embodiment, an upper surface of the urging member 31*a* is, as shown in (b-1) and (b-2) of FIG. 2, projected toward the intermediary transfer belt 13 at its downstream side end portion 31*a*2 more than at its upstream side end portion 31*a*1. In this embodiment, the projected portion formed at the downstream end portion 31*a*2 is present within the transfer nip region N. As a result, at the projected portion 31*a*2, the sheet member 32*a* is urged upward, so that the sheet member 32*a* is intimately contacted to the intermediary transfer belt 13 to form the downstream tension nip region Nt (between B and C). By ensuring the downstream tension nip region Nt, the above-described electric charge circulating action is exerted, so that it is possible to prevent the occurrence of the image defect due to the abnormal electric discharge. In (b-1) of FIG. 2, an edge line 31*a*3 connecting upstream and downstream edges 31*a*1 and 31*a*2 of the elastic member 31*a* had an arcuate shape following a moderate curve of the sheet member 32*a*. However, even when the edge line 31*a*3 connecting the both edges 31*a*1 and 31*a*2 have a linear shape as shown in (b-2) of FIG. 2, the downstream edge 31*a*2 is projected toward the intermediary transfer belt 13, so that the same effect can be achieved.

Evaluation of First Embodiment

In order to check the effect of the image forming apparatus in this embodiment, by using the image forming apparatus of 100 mm/sec in process speed, evaluation was performed with respect to an abnormal electric discharge image at an initial stage and after sheet passing of 10,000 sheets in each of this embodiment and Comparative Embodiment 1. Incidentally, a sheet passing durability test was conducted by using paper ("Xerox 4024", mfd. by Xerox Corp.; basis weight=75 g/m$^2$, and an image after passing of 10,000 sheets for accelerating toner deterioration by the durability test was evaluated.

In the constitution in this embodiment, the abnormal electric discharge image was not generated and was good from the initial stage to after the sheet passing of 10,000 sheets.

Comparative Embodiment 1

Parts (a) to (c) of FIG. 3 are schematic views for illustrating Comparative Embodiment 1. In Comparative Embodiment 1, as shown in (a) of FIG. 3, a primary transfer member 10*a*-1 has the same constitution as that of First Embodiment except that only a shape of an urging member 31*a* is different. Therefore, general structure and operation of the primary transfer member 10*a*-1 are the same as those in First Embodiment and will be omitted from detailed description.

In Comparative Embodiment 1, the free end portion of the sheet member 32*a* supported by the sheet member supporting member 33*a* at another end portion of the sheet member 32*a* is urged by the urging member 31*a* urged against the sheet member 32*a* by the spring member 34*a*, so that the belt 13 is urged toward the image bearing member 1*a*.

The shape of the urging member 31*a* which urges the sheet member 32*a* is a rectangular parallelopiped shape and therefore in some cases, the close contactness between the sheet member 32*a* and the belt 13 is insufficient as the region between B and C in FIG. 3 as a result that the degree of close contactness is inferior to rigidity (stiffness) of the sheet member 32*a*. As a result, in some cases, a sufficient downstream tension nip region (between B and C) was not capable of being ensured. Incidentally, also the second to fourth stations Sb to Sd have the same constitution as that of the first station Sa and therefore will be omitted from description.

Next, an evaluation result will be described. With respect to Comparative Embodiment 1, in the downstream tension nip region Nt (between B and C), the intermediary transfer belt 13 and the sheet member 32*a* cannot intimately contact in some cases and thus the electric charge circulating function is not performed, so that it was confirmed that the abnormal electric discharge image was generated.

Incidentally, even in the case of the rectangular parallelopiped as shown in (b) and (c) of FIG. 3, by including a bearing surface of the spring member 34*a* as shown in FIG. 4, the upper surface 31*a*3 of the urging member 31*a* opposing the sheet member 32*a* is not parallel to the belt 13. That is, by rotating the holding member 35*a* which holds the urging member 31*a* via the spring member 34*a*, the upper surface 31*a*3 of the urging member 31*a* is not parallel to the belt 13, so that the downstream portion 31*a*2 is projected and thus it is possible to obtain the same effect as that in the constitution of FIG. 2.

From the above, as in First Embodiment, the shape of the top surface of the elastic member 31*a* is such that the downstream side end portion 31*a*2 is projected toward the intermediary transfer belt 13 more than the upstream side end portion 31*a*1 and therefore the intermediary transfer belt 13 and the sheet member 32*a* can be closely contacted to each other with no gap in the downstream tension nip region Nt (between B and C). As a result, in the downstream tension nip region Nt, the circulating function of the electric charges injected from the sheet member 32*a* is performed, so that it is possible to suppress the occurrence of the image defect due to the abnormal electric discharge.

Second Embodiment

A basic constitution of an image forming apparatus to which the present invention is applied in this embodiment is the same as that in First Embodiment and therefore elements or portions having the same or corresponding functions and constitutions as those in First Embodiment are represented by the same reference numerals or symbols and will be omitted from detailed description.

Second Embodiment is characterized in that the urging member 31*a* is constituted by two members. This feature will be described below.

The urging member 31*a* used in this embodiment is constituted by the two members as shown in (a), (b) and (c) of FIG. 5. An upstream side member 31*a*A has the same hardness as that in First Embodiment, i.e., 30 degrees in terms of Asker C hardness under the load of 500 gf. On the other hand, a downstream side member 31*a*B has a high hardness of 50 degrees in terms of Asker C hardness under the load of o500 gf. The downstream side member 31*a*B is used in the physical nip roller Np (between A and B) and is contacted to the sheet member 32*a* toward the photosensitive drum 1*a* and therefore when a durability test proceeds, a shape change thereof such as permanent deformation can occur. In this embodiment, in order to prevent the permanent deformation after the durability test, the hardness of the downstream side member 31*a*B is made high. The upstream side member 31*a*A is contacted to the sheet member 32*a* at its corner 31*a*1 and thus there is a possibility that it damages the sheet member 32*a* when its hardness is excessively high, and therefore may preferably have a low hardness.

The urging member 31*a* constituted by the two members is prepared by providing the upstream side member 31*a*A and the downstream side member 31*a*B as different members but can also be prepared by integrally molding the upstream side member 31*a*A and the downstream side member 31*a*B.

Even in the case of the urging member 31*a* constituted by the two members as in this embodiment, by the presence a portion 31*a*2 (31*a*2-1, 31*a*2-2) at the downstream side portion projected more than at the upstream side end portion 31*a*, the sheet member 32*a* is pushed up as shown in (a) of FIG. 5. That is, in this embodiment, the edge line of the urging member 31*a* is stepwisely increased (stepped) from the upstream side 31*a* toward the downstream side end portion 31*a*2-2, so that the sheet member 32*a* is urged against the belt 13. As a result, the intermediary transfer belt 13 and the sheet member 32*a* are closedly contacted and thus the downstream tension nip region Nt (between B and C) can be ensured, so that it is possible to prevent the occurrence of the image defect due to the abnormal electric discharge.

Further, as the urging member 31*a* constituted by the two members, as shown in (a), (b) and (c) of FIG. 6, the urging member 31*a* can be constituted by two members, i.e., an urging member 31*a*A, located in the upstream side of the intermediary transfer belt conveyance direction, for urging the sheet member 32*a* and a downstream side inclination preventing member 31*a*C as a regulating member for regulating inclination of the urging member 31*a*A.

The urging member 31*a*A has the same constitutions that of the urging member 31*a* shown in FIG. 2. Further, the inclination preventing member 31*a*C is disposed at a position downstream of the urging member 31*a*A with respect to the intermediary transfer belt conveyance direction to performing a function of preventing the urging member 31*a*A located in the upstream side from being inclined toward the downstream side with respect to the intermediary transfer belt conveyance direction.

Also in the constitution of FIG. 6, a downstream portion 31*a*2 of the urging member 31*a*A is projected toward the belt 13 and thus the downstream tension nip region Nt (between B and C) can be ensured, so that the same effect as that described in First Embodiment can be obtained.

Further, the inclination preventing member 31*a*C can be formed of the same material as that for the urging member 31*a*B in the constitution of FIG. 5 and may also be formed of another plastic resin or the like. Further, the inclination preventing member 31*a*C is prepared as a different member from the urging member 31*a*A but may also be molded integrally with the urging member 31*a*A.

Further, the inclination preventing member 31*a*C may also be, in the case where it is prepared as the different member from the urging member 31*a*A, as shown in (a) and (c) of FIG. 6, molded integrally with a support member 31*a*D, and this support member 31*a*D can also be mounted on the urging member holding member 35*a*.

In the above-described First and Second Embodiments, the image forming apparatus of the present invention was described as the color image forming apparatus of the intermediary transfer type.

However, the present invention is similarly applicable to a so-called image forming apparatus of a direct transfer type, as shown in FIG. 7, in which a transfer material conveying member, which is an endless belt member for conveying a transfer material P, i.e., a transfer material conveying belt 110 is provided in place of the intermediary transfer belt 13. The image forming apparatus of the direct transfer type has a constitution in which toner images formed on surfaces of photosensitive drums 1 (1*a* to 1*d*) are successively transferred directly onto the transfer material P conveyed to respective image forming portions by the transfer member conveying belt to form (record) a color image. Such an image forming apparatus is well known by a person ordinarily skilled in the art and therefore will be omitted from further description. Further, the present invention is also applicable to a monochromatic image forming apparatus.

Further, in the above-described embodiments, the printer is used as the example of the image forming apparatus but the present invention is not limited thereto. For example, the image forming apparatus of the present invention may also be other image forming apparatuses, such as a copying machine, a facsimile machine and a multi-function machine having a combination of these functions. By applying the present invention to these image forming apparatuses, a similar effect can be achieved.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 167331/2011 filed Jul. 29, 2011, which is hereby incorporated by reference.

What is claimed is:

1. An image forming apparatus comprising:

an image bearing member on which a toner image is to be formed;

a transfer device for transferring the toner image carried on said image bearing member; and a rotationally movable endless transfer belt onto which the toner image is to be transferred or on which a transfer material onto which the toner image is to be transferred is to be conveyed, wherein said transfer device includes a sheet member contacted to an inner peripheral surface of said transfer belt while being supported by a supporting member at an end thereof and includes an urging member for urging said sheet member against said transfer belt in contact with said sheet member, and wherein said urging member includes a projected portion projecting in a direction toward said transfer belt at a location within a physical nip region in which said image bearing member and said transfer belt contact each other and in which said transfer belt and said sheet member contact each other.

2. An apparatus according to claim 1, wherein said sheet member is supported by said supporting member at its upstream end with respect to the movement direction of said transfer belt and has a free end at its downstream end with respect to the movement direction of said transfer belt.

3. An apparatus according to claim 1, wherein said sheet member is contacted to the inner peripheral surface of said transfer belt in a transfer nip region consisting of the physical nip region and a downstream nip region, located downstream of the physical nip region, where said transfer belt and said sheet member contact each other.

4. An apparatus according to claim 1, wherein said urging member has an arcuate shape so that its height toward said transfer belt is increased from the downstream end portion to the upstream end portion.

5. An apparatus according to claim 1, wherein said urging member has a linear shape so that its height toward said transfer belt is increased from the downstream end portion to the upstream end portion.

6. An apparatus according to claim 1, wherein said urging member has a stepped shape so that its height toward said transfer belt is increased from the downstream end portion to the upstream end portion.

7. An apparatus according to claim 3, wherein said urging member is a rectangular parallelopiped supported by a supporting portion, and wherein the supporting portion supports the rectangular parallelopiped so that its surface opposing the inner peripheral surface of said transfer belt is inclined with respect to the inner peripheral surface of said transfer belt in the transfer nip region.

8. An apparatus according to claim 1, wherein said urging member includes a first member and a second member located upstream of the first member with respect to the movement direction of said transfer belt, and wherein the first member is higher in hardness than the second member.

9. An apparatus according to claim 1, wherein the first member urges said transfer belt in the physical nip region with respect to the movement direction of said transfer belt.

10. An apparatus according to claim 1, wherein said urging member includes a first member and a second member located upstream of the first member with respect to the movement direction of said transfer belt, and wherein the projected portion most projected toward said transfer belt is a part of the first member.

11. An apparatus according to claim 1, further comprising a regulating member, provided downstream of said urging member with respect to the movement direction of said transfer belt, for regulating a position of said urging member with respect to the movement direction.

12. An apparatus according to claim 1, wherein said transfer belt is an intermediary transfer belt onto which the toner image is transferred from said image bearing member.

13. An apparatus according to claim 1, wherein said transfer belt is a transfer material conveying belt for conveying a transfer material onto which the toner image is to be transferred from said image bearing member.

14. An apparatus according to claim 1, wherein a plurality of image bearing members and a plurality of transfer devices are provided, and wherein a color toner images is transferable onto the transfer material.

* * * * *